US009131815B2

(12) United States Patent
Genoa et al.

(10) Patent No.: US 9,131,815 B2
(45) Date of Patent: Sep. 15, 2015

(54) VACUUM CLEANER HOSE ASSEMBLY CONNECTOR

(76) Inventors: Mark Genoa, Dix Hills, NY (US); Scott Genoa, Merrick, NY (US)

( * ) Notice: Subject to any disclaimer, the term of this patent is extended or adjusted under 35 U.S.C. 154(b) by 565 days.

(21) Appl. No.: 13/290,626

(22) Filed: Nov. 7, 2011

(65) Prior Publication Data

US 2013/0111699 A1 May 9, 2013

(51) Int. Cl.
*A47L 5/22* (2006.01)
*A47L 9/24* (2006.01)

(52) U.S. Cl.
CPC ..... *A47L 5/225* (2013.01); *A47L 9/242* (2013.01); *Y10T 29/49826* (2015.01)

(58) Field of Classification Search
CPC ..... A47L 9/02; A47L 9/244; A47L 9/242; A47L 5/14; A47L 5/32; A47L 9/0036
USPC ..... 15/414, 327.1, 327.7, 339, 377; 285/7, 285/179, 272, 275
See application file for complete search history.

(56) References Cited

U.S. PATENT DOCUMENTS

| | | | | |
|---|---|---|---|---|
| 3,565,464 | A * | 2/1971 | Wolf | 285/7 |
| 4,161,956 | A * | 7/1979 | Hadgkiss | 134/167 C |
| 4,345,805 | A | 8/1982 | Finley et al. | |
| 4,557,535 | A | 12/1985 | Keane | |
| 4,940,415 | A * | 7/1990 | Westergren | 439/192 |
| 5,216,778 | A * | 6/1993 | Suzuki et al. | 15/327.1 |
| 5,735,017 | A * | 4/1998 | Barnes et al. | 15/321 |
| 5,755,578 | A * | 5/1998 | Contant et al. | 439/23 |
| 6,015,298 | A | 1/2000 | Linhart | |
| 6,087,595 | A | 7/2000 | Linhart | |
| 6,353,178 | B1 | 3/2002 | Linhart | |
| 6,722,904 | B2 | 4/2004 | Linhart | |
| 6,733,315 | B2 | 5/2004 | Linhart | |
| 2007/0218734 | A1 | 9/2007 | Walter et al. | |
| 2014/0306444 | A1 | 10/2014 | Cordes et al. | |

* cited by examiner

*Primary Examiner* — Robert Scruggs
(74) *Attorney, Agent, or Firm* — Holtz, Holtz, Goodman & Chick PC

(57) ABSTRACT

Connector for connecting a vacuum hose to a vacuum cleaner body includes a central tube removably connected to the body and an enclosure that at least partially encloses the central tube and the vacuum hose when positioned partly over the central tube. The connector retains the vacuum hose to allow for swiveling of the vacuum hose about the central tube and prevents rotation between the central tube and the enclosure.

25 Claims, 5 Drawing Sheets

VACUUM CLEANER HOSE ASSEMBLY CONNECTOR

FIELD OF THE INVENTION

The present invention relates generally to a connector for a vacuum cleaner that connects a vacuum cleaner hose to a vacuum cleaner body and more specifically, to such a vacuum hose connector that allows the vacuum hose to swivel about the connector while the connector does not move relative to the vacuum cleaner body.

The present invention also relates to a method for connecting a vacuum hose to a vacuum cleaner body using a connector that allows the vacuum hose to swivel about the connector while the connector does not move relative to the vacuum cleaner body.

BACKGROUND OF THE INVENTION

A vacuum cleaner hose assembly having a vacuum cleaner hose and a swivel coupling for coupling the vacuum cleaner hose to a vacuum cleaner body to allow swiveling of the vacuum cleaner hose about a swivel axis and at an angle relative to the swivel axis is known in the prior art. For example, U.S. Pat. No. 5,755,578 (Contant et al.) describes a vacuum cleaner hose assembly that has a swivel coupling comprising a hose guide that surrounds a flexible portion of a vacuum cleaner hose and holds this flexible portion of the vacuum cleaner hose in a curved position.

Also, U.S. Pat. No. 4,557,535 (Keane) describes a vacuum cleaner having a hose swivelly connected to a canister portion suction inlet. A swivel connector has a first portion secured to a hose end and a second portion removably secured to a canister housing inlet. The first swivel connector portion is swivelly connected to the second portion. An electrical power plug is removably mounted to the swivel connector second portion and a first interlock is provided on the plug and swivel connector second portion for releasably locking the plug to the swivel connector second portion. A second interlock is provided on the plug and swivel connector first portion for preventing axial separation of the first and second swivel connector portions.

In spite of these prior art swivel connectors for vacuum cleaners, a new and improved swivel connector for connecting a vacuum cleaner hose to a vacuum cleaner body is sought.

SUMMARY OF THE INVENTION

A connector for connecting a vacuum hose assembly to a vacuum cleaner body in accordance with the invention includes a central tube, and an enclosure that at least partially encloses the central tube and the vacuum hose assembly when positioned partly over a portion of the central tube. The enclosure includes a retaining structure that retains the vacuum hose assembly in position partly over the portion of the central tube to allow for swiveling of the vacuum hose assembly about the central tube, e.g., a pair of rims that define a channel therebetween into which a flange of the vacuum hose assembly is positioned. The connector also includes rotation prevention structure that prevents rotation between the central tube and the enclosure, e.g., one or more keyways on an inner side of the enclosure and one or more cooperating keys formed on the outer surface of the central tube.

A vacuum cleaner in accordance with the invention includes the connector described above, as well as a vacuum body for generating vacuum force and a vacuum hose assembly extending from the vacuum body and that is connected to vacuum body by the connector.

A method for connecting a vacuum hose assembly to a vacuum cleaner body in accordance with the invention includes positioning an end of a vacuum hose of the vacuum hose assembly over part of a central tube of a connector, and then enclosing part of the central tube including a portion over which the vacuum hose assembly is positioned by means of an enclosure to thereby enclose part of the vacuum hose assembly and part of the central tube. Enclosing part of the central tube may entail forming a channel in the enclosure to allow rotation of a flange of the vacuum hose assembly situated in the channel and forming cooperating rotation-prevention structure on the central tube and the enclosure such that when cooperating, the rotation-prevention structure prevents rotation of the central tube relative to the enclosure. The central tube is attached to the body. As such, swiveling of the vacuum hose relative to the central tube is permitted while rotation of the central tube relative to the enclosure is prevented.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 1:
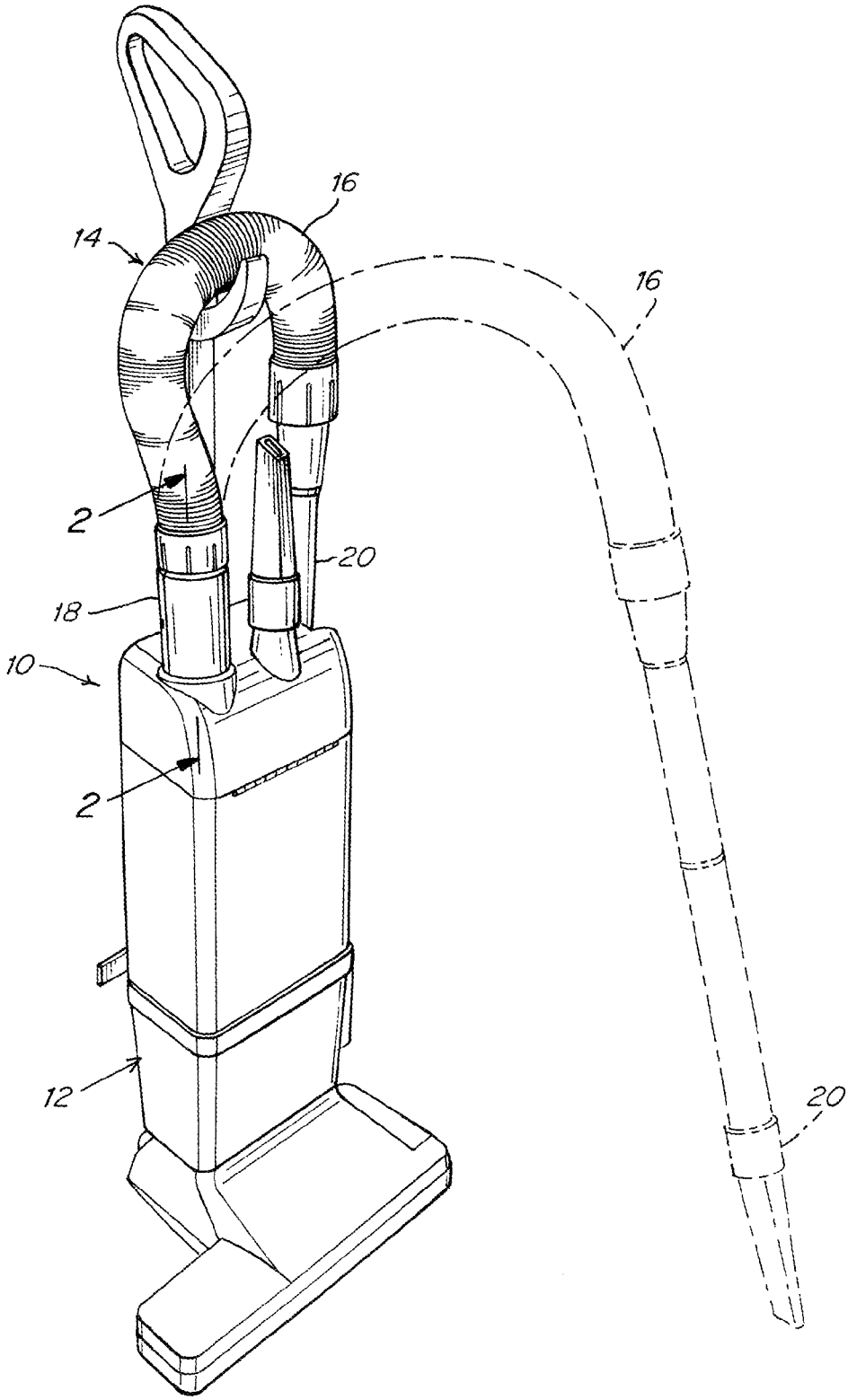
FIG. 1 is a perspective view of a vacuum cleaner including a vacuum hose used with a crevice tool shown in a stowed position in solid lines and in a use position in phantom lines, the vacuum cleaner including a vacuum hose connector in accordance with the invention that connects the vacuum hose to a vacuum body of the vacuum cleaner.

Referring to the accompanying drawings wherein like reference numbers refer to the same or similar elements, FIG. 1 is a perspective view of a vacuum cleaner 10 in which pertinent parts relative to the instant invention are identified. The vacuum cleaner 10 includes a vacuum body 12, including hardware necessary to perform usual functions of a vacuum cleaner such as generating a vacuum force, and a vacuum hose assembly 14 including a vacuum hose 16 that is coupled to the vacuum body 12 via a connector 18. Vacuum hose assembly 14 may have any one of a number of different cleaning attachment tools attached to the end of the vacuum hose 16, including, for example, a crevice tool 20. The invention is not limited to any specific attachment tools that are attached to the end of the vacuum hose 16, and relates primarily to the manner in which the vacuum hose 16 is connected to the vacuum body 12 via the connector 18 and a vacuum cleaner 10 including this particular connector 18, and a method for connecting a vacuum hose assembly to the vacuum body using this connector 18.

The connector 18 engages with the vacuum body 12 via a threaded connection. To this end, the vacuum body 12 is provided with a socket or threaded portion 22 and the connector 18 is provided with a cooperating threaded portion 24. The threaded portion 22 of the vacuum body 12 includes a recessed tubular portion 26 and one or more threads 28 formed on an inner surface of the tubular portion 26 (see FIGS. 2 and 3). The threaded portion 24 on the connector 18 includes a projection 30 formed at one end of the connector 18 and one or more threads 32 on the outer surface of the projection 30 that cooperates with the one or more threads 28 on the inner surface of the tubular portion 26 on the vacuum body 12. By rotating the connector 18 in one direction (arrow A in FIG. 2) once the threaded portion 24 of the connector 18 is in contact with the threaded portion 22 of the vacuum body 12, the connector 18 can be secured to the vacuum body 12. Upon rotation of the connector 18 in the opposite direction (arrow B in FIG. 3), the connector 18 is removed from engagement with the vacuum body 12.

Figure 2:
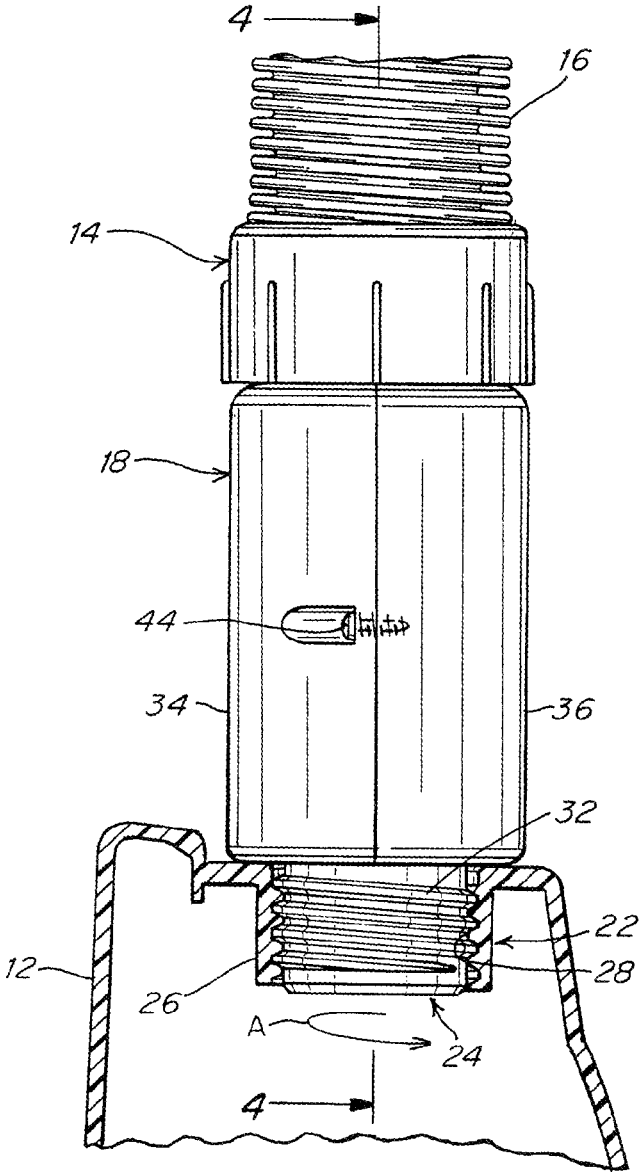
FIG. 2 is a fragmentary cross-sectional view of the hose connector tightened in its threaded socket in the vacuum body taken along line 2-2 of FIG. 1.
Figure 3:
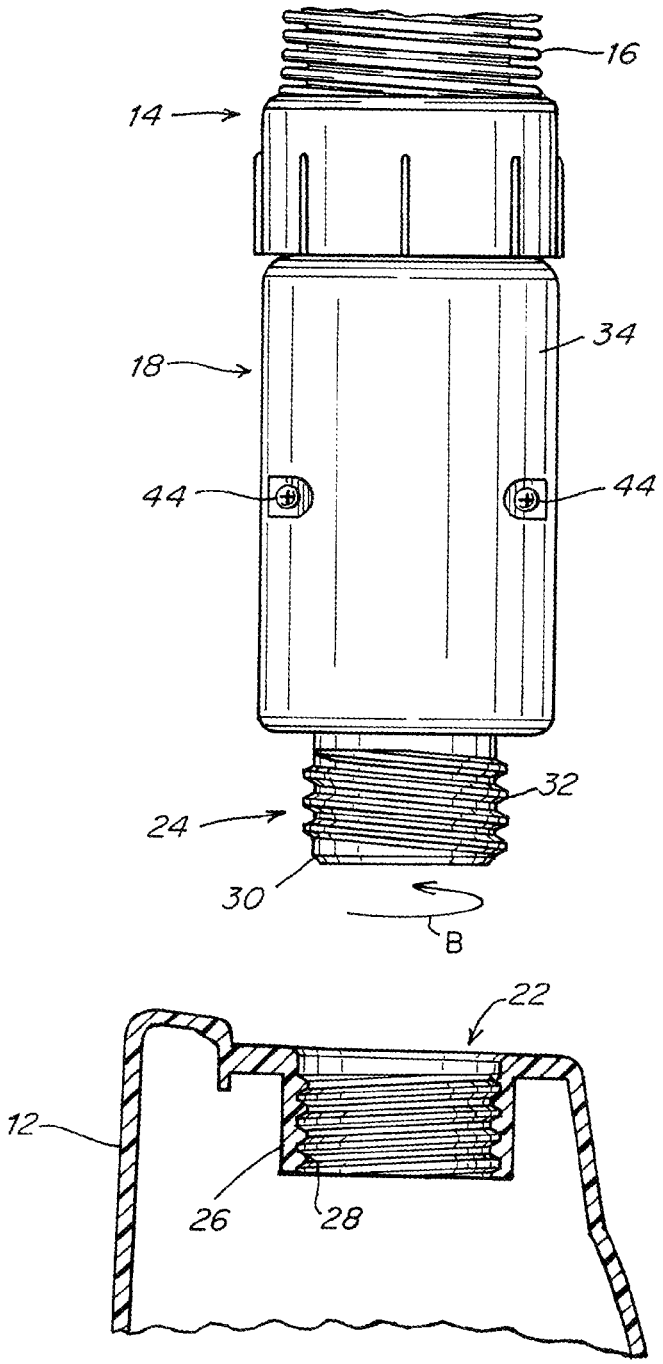
FIG. 3 is a cross-sectional view similar to FIG. 2 but showing the hose connector unscrewed from its threaded socket.

The threaded connection provided by threads 28 on the vacuum body 12 and threads 32 on the connector 16 is a left-hand or reverse thread, i.e., opposite from the usual screw thread. As such, arrow A represents a counterclockwise turn which is needed to attach the connector 18 to the vacuum body 12 (FIG. 2). On the other hand, arrow B represents a clockwise turn which is needed to detach the connector 18 from the vacuum body 12 (FIG. 3). If a user tries to unscrew the connector 18 by turning the connector 18 in the usual counterclockwise direction, the result will be to tighten the connection of the connector 18 to the vacuum body 12. By configuring the threads 28, 32 in this manner, inadvertent or intentional removal of the vacuum hose assembly 14 and connector 18 connected thereto is avoided or prevented. This increases security of the vacuum cleaner 10 including the connector 18.

Moreover, in view of the left-hand or reverse threading on the connector 18 and vacuum body 12, as the user uses the vacuum hose assembly 14 for vacuuming, its swiveling will also cause tightening of the attachment of the connector 18 to the vacuum body 12. This tightening further aids in preventing the vacuum hose assembly 14 and attached connector 18 from falling off during use.

Instead of a threaded connection between the connector 18 and the vacuum body 12, other removable connections may be used in accordance with the invention. As such, the vacuum cleaner 10 would therefore generally includes means for removably connecting the connector 18 to the vacuum body 12, such means including but not being limited to a threaded connection via cooperating threads formed on the connector 18 and the vacuum body 12. Further, although a removable connection of the connector 18 to the vacuum body 12 may be preferred, in some circumstances, a more permanent connection of the connector 18 to the vacuum body 12 may be provided.

Figure 4:
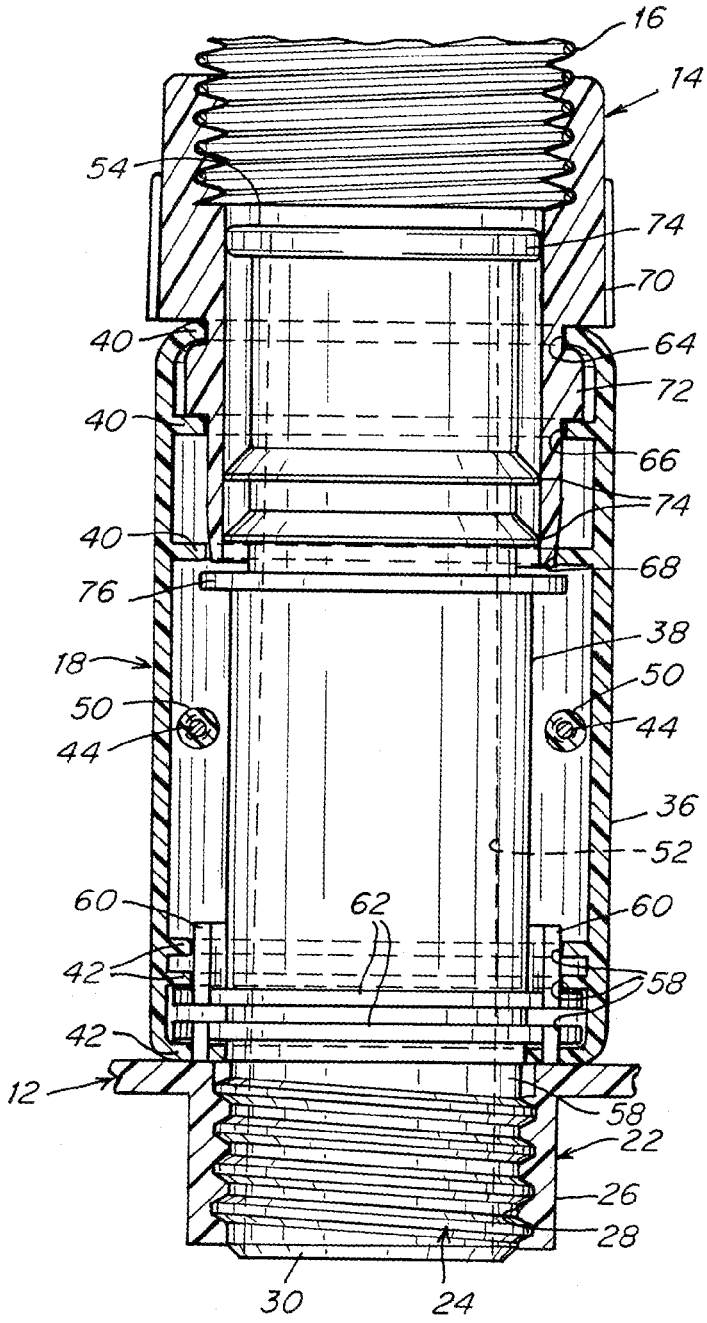
FIG. 4 is cross-sectional view of the connector and socket taken along line 4-4 of FIG. 2.
Figure 5:
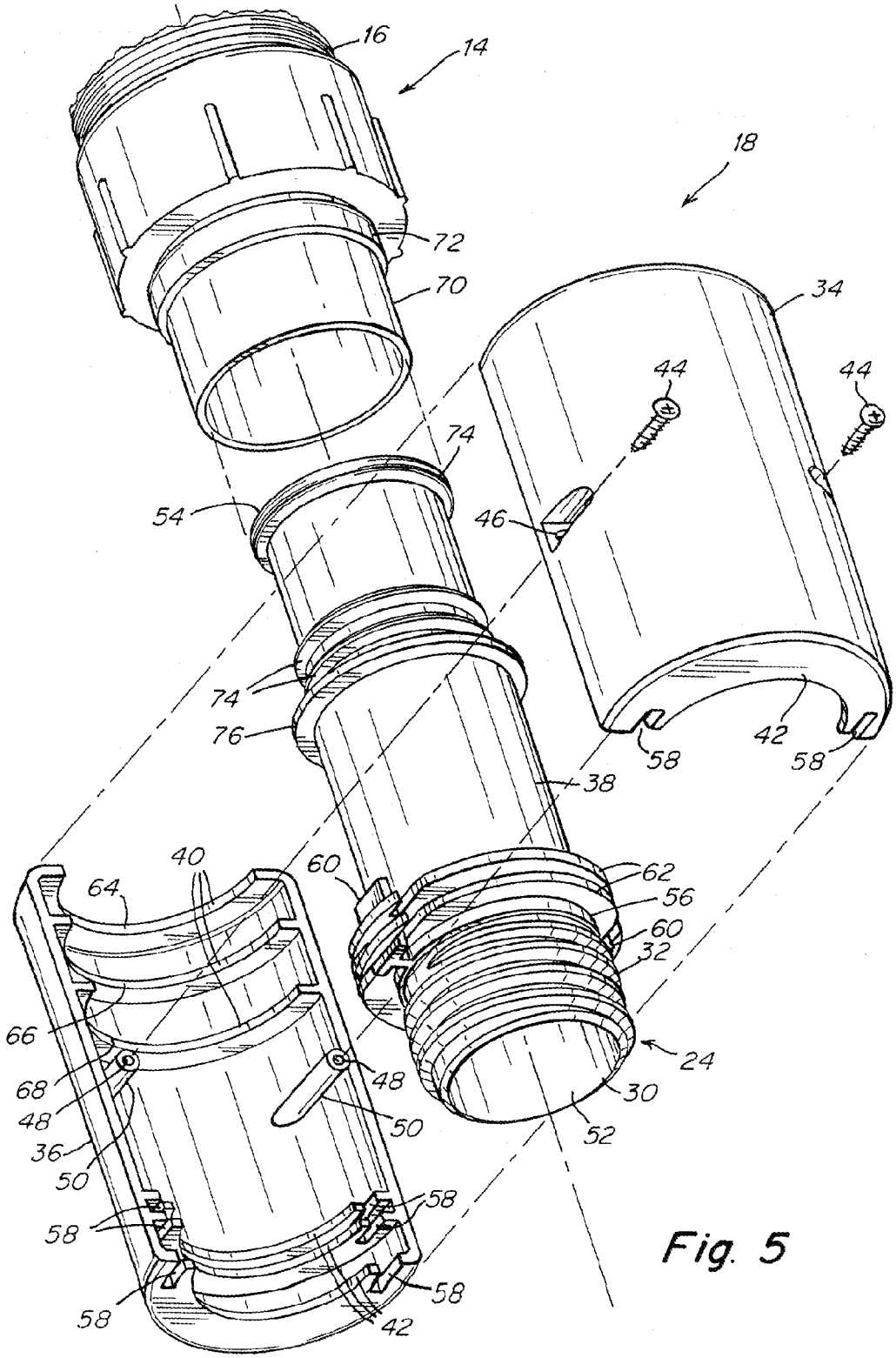
FIG. 5 is an exploded perspective view of the connector and hose end by themselves.

Referring now in particular to FIGS. 4 and 5, the connector includes a pair of generally semi-cylindrical shells 34, 36 that are attached to one another, and a central tube 38 that is partly surrounded by the shells 34, 36. Shells 34, 36, when attached together, define apertures at opposite ends, with the projection 30 extending through an aperture at one end, and part of the central tube 38 and vacuum hose assembly 14 engaged therewith extending through the aperture at the opposite end. These apertures are defined by a flange or rim 40, 42, described more fully below, part of which is situated on each of the shells 34, 36. Thus, each shell 34, 36 has a semi-circular portion of each of the rims 40, 42 (see FIG. 5).

The attachment structure that attaches the shells 34, 36 together comprises screws 44 that are screwed through apertures 46 in one shell 34 and into receptacles 48 in the other shell 36 (see FIG. 5). Instead of screws 44, other attachment mechanisms may be used to attach the shells 34, 36 together.

Receptacles 48 may be defined by projections 50. Screws 44 enable the shells 34, 36 to retain part of the vacuum hose assembly 14 that surrounds part of the central tube 38 therebetween (discussed more fully below in the discussion of the assembly of the connector 18 in combination with the vacuum hose assembly 14).

Shells 34, 36 exemplify an enclosure that encloses part of the central tube 38 and part of the vacuum hose assembly 14 that surrounds a portion of the central tube 38, and serves to secure central tube 38 and vacuum hose assembly 14 in engagement with one another. Other types of enclosures are envisioned in the invention, whether made of a single piece or member, or two or more pieces or members that require attachment means to enable them to be connected together to form the enclosure. In a preferred embodiment, such an enclosure at least encloses part of the central tube 38 and maintains part of the vacuum hose assembly 14 in a fixed position relative to the central tube 38 to ensure transfer of the vacuum force through the central tube 38 to the vacuum hose assembly 14. The enclosure may preferably also engage with part of the vacuum hose assembly 14 in order to maintain it in a fixed position relative to the central tube 38.

Central tube 38 has a generally tubular form and defines an interior conduit 52 for air flow between the hose 14 and the interior of the vacuum body 12. Projection 30 is formed at one end of the central tube 38 (see FIG. 5) and protrudes from an aperture formed by the shells 34, 36 when attached to one another to enable its connection to the vacuum body 12.

Connector 18 is designed to allow the vacuum hose assembly connected at a hose end 54 of the connector 16 to swivel about the connector 16 while the connector 16 is connected at a vacuum body end 56 to the vacuum body 12 (see FIG. 5). More specifically, the connector 18 allows for swiveling of the vacuum hose assembly 14 about the central tube 38 while the central tube 38 is attached to the vacuum body 12 and held against rotation relative to the shells 34, 36.

To prevent rotation of the shells 34, 36 relative to the central tube 38 and thus relative to the vacuum body 12 to which the central tube 38 is attached, each shell 34, 36 includes rims 42 on its inner surface proximate the vacuum body end 56. Rims 42 define keyways 58, while cooperating keys 60 are arranged on the outer surface of the central tube 38 (see FIG. 5).

When the shells 34, 36 are attached to one another, the keys 60 register with the keyways 58 and the presence of the keys 60 in the keyways 58 prevents relative rotation between the central tube 38 and shells 34, 36, and thus relative rotation between the vacuum body 12 to which the central tube 38 is attached and the shells 34, 36. Keys 60 may be formed in combination with annular flanges 62 on the outer surface of the central tube 38. In this manner, rotational force against the shells 32, 34 and central tube 38 imparted by the swiveling of the vacuum tube assembly 14 about the central tube 38 is not transferred to the shells 34, 36 or central tube 38.

Although shell 36 is shown with three rims 42, and shell 34 includes the same number, any number of rims 42 may be used in the invention. At least one of the rims 42 must include a keyway 58, and the central tube 38 must therefore include at least one key 60 aligning with that keyway 58. The lowermost rim 42 may abut against the vacuum body 12 (see FIG. 4).

Keys 58 and cooperating keyways 60 exemplify rotation prevention means for preventing relative rotation between the central tube 38 and the shells 34, 36. Other rotation prevention means are envisioned for the invention. For example, keys may be formed on one or more of the shells 34, 36 and cooperating keyways may be formed on the central tube 38. Yet other techniques for preventing rotation between a tube and its enclosure may be used in the invention, including techniques known to those skilled in the art and all such techniques are considered part of the invention.

To enable swiveling of the vacuum hose assembly 14 relative to the connector 18, rims 40 define bearing surfaces 64, 66, 68 that bear against an outer circumferential surface of a molded hose end 70 of the vacuum hose assembly 14 (see FIGS. 4 and 5). Bearing surfaces 64, 66 trapped a flange 72 formed on the molded hose end 70 of the vacuum hose assembly 14 to prevent its axial movement but allow its swiveling. Other means for retaining the molded hose end 70 of the vacuum hose assembly 14 in connection with the connector 18 that allow for swiveling of the vacuum hose assembly 14 relative to the connector 18 are also envisioned in the invention. Thus, the bearing surfaces 64, 66 that secure the flange 72 exemplify means for connecting the vacuum hose assembly 14 to the connector 18 while allowing for swiveling of the vacuum hose assembly 14 relative to the connector 18 and limiting axial movement of the vacuum hose assembly 14 relative to the connector 18 to ensure that the vacuum hose assembly 14 remains in engagement with the connector 18 during its swiveling motion.

The connection of the vacuum hose assembly 14 to the central tube 38 also requires sealing to ensure adequate vacuum force in the vacuum hose assembly 14 and to this end, seals 74 are formed on the outer surface of the central tube 38. The illustrated embodiment includes three seals 74, a first one at the hose end 54 of the connector 18, and then two additional seals 74 proximate an insertion-limiting flange 76 arranged on the outer circumferential surface of the central tube 38. Seals 74 may be formed integral with the central tube 38 to project from an outer, otherwise substantially cylindrical surface thereof between the insertion-limiting flange 76 and the hose end 54. Similarly, the insertion-limiting flange 76 may be formed integral with the central tube 38 to project from an outer, otherwise substantially cylindrical surface thereof.

The two seals 74 proximate the insertion-limiting flange 76 of the central tube 38 will thus be close to the edge of the hose end 70 of the vacuum hose assembly 14 (see FIG. 4). Seals 74 air seal the vacuum and also act as bearing surfaces between the inner surface of the hose end 70 of the vacuum hose assembly 14 and the outer surface of the central tube 38.

Although the illustrated embodiment shows three seals 74, any number of seals may be used in the invention. Alternatively, different sealing mechanisms may be used in the invention, for example, seals formed on the inner surface of the hose end 70 that are brought into contact with an outer cylindrical surface of the central tube 38. Thus, the sealing means for sealing the vacuum may be formed on the central tube 38 and/or on the hose end 70 of the vacuum hose assembly 14.

A vacuum cleaner hose arrangement in accordance with the invention includes a vacuum hose assembly 14 and a connector 18. This vacuum hose arrangement can be easily connected to the vacuum body 12 via the threaded portions 22, 24 of the vacuum body 12 and the connector 18, respectively.

One way to assemble the vacuum hose arrangement is to place the molded hose end 70 of the vacuum hose assembly 14 over the seals 74 until the leading edge of the hose end 70 is against or proximate the insertion-limiting flange 76. Preferably, the hose end 70 should extend over all three seals 74. Then, while holding the hose end 70 of the vacuum hose assembly 14 over the seals 74 and thus around a part of the central tube 38, one of the shells 34, 36 is positioned such that one side of the flange 72 is positioned between bearing surfaces 64, 66 of this shell and the keys 60 on the central tube 38 register with the aligning keyways 58. The other one of the shells 34, 36 is then positioned such that the other side of the flange 72 is positioned between bearing surfaces 64, 66 of this shell and the keys 60 register with the keyways 58, and such that the apertures 46 and receptacles 48 align with one another.

Screws 44 are then inserted through apertures 46 into receptacles 48 and tightened, thereby securing the shells 34, 36 around the central tube 38 and vacuum hose assembly 14 over part of the central tube 38. Connector 18 is thereby formed with the vacuum hose assembly 14 secured to the central tube 38 in a manner allowing for swiveling of the vacuum hose assembly 14 relative to the central tube 38 and more generally, relative to the connector 18. Further, a seal is provided between the seals 74 and the hose end 70 of the vacuum hose assembly 14 to allow the vacuum force provided by structure in the vacuum body 12 to be effective in the vacuum hose assembly 14.

Subsequent attachment of the connector 18 to the vacuum body 12 via the threaded portions 22, 24 secures the connector 18 to the vacuum body 12 and in this state, the vacuum cleaner 10 is operational. When vacuuming using the vacuum cleaner 10, the vacuum hose assembly 14 can swivel relative to the connector 18 which is fixed to the vacuum body 12 and therefore the vacuum hose assembly 14 swivels relative to the vacuum body 12.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A connector for connecting a vacuum hose assembly to a vacuum cleaner body, comprising:

an elongate central tube;

an enclosure that partially encloses said central tube, first and second portions of said central tube at opposite first and second ends of said central tube extending beyond respective ends of said enclosure and thus not being enclosed by said enclosure, said first portion of said central tube at said first end being adapted to removably engage with the vacuum body;

said enclosure including retaining means for retaining the vacuum hose assembly in position partly alongside and outward of said second portion of said central tube that extends beyond the second end of the enclosure to allow for swiveling of the vacuum hose assembly about said central tube; and rotation prevention means for preventing rotation of said enclosure relative to said central tube.

2. The connector of claim 1, wherein said rotation prevention means comprise at least one rim on an inner surface of said enclosure that each include a keyway, and a respective cooperating key on an outer surface of said central tube.

3. The connector of claim 1, wherein said rotation prevention means comprise a plurality of rims on an inner surface of said enclosure that each include a keyway, and a plurality of cooperating keys on an outer surface of said central tube.

4. The connector of claim 1, wherein said enclosure comprises a pair of generally semi-cylindrical shells and attachment means for attaching said shells together.

5. The connector of claim 4, wherein said rotation prevention means comprise at least one rim on an inner surface of each of said shells that each include a keyway, and a respective cooperating key on an outer surface of said central tube.

6. The connector of claim 1, wherein said first portion includes a first threaded portion adapted to threadingly engage with a second threaded portion on the vacuum body, said first threaded portion being configured to require a left-hand turn to engage with the second threaded portion.

7. The connector of claim 1, wherein said central tube defines an interior conduit for air flow between the vacuum hose assembly and an interior of the vacuum body, further comprising sealing means arranged on said central tube for sealing a space between said central tube and the vacuum body.

8. The connector of claim 1, wherein said retaining means comprise a pair of annular bearing surfaces on an inner surface of said enclosure that are adapted to bear against an outer circumferential surface of the vacuum hose assembly when the vacuum hose assembly is positioned alongside and outward of said second portion of said central tube, one of said bearing surfaces being adapted to be positioned above a flange of the vacuum hose assembly and the other of said bearing surfaces being adapted to be positioned below the flange of the vacuum hose assembly.

9. The connector of claim 1, wherein said enclosure includes a rim on a same side of said central tube as said first portion, said first portion extending beyond said rim.

10. The connector of claim 1, wherein said connector in its entirety is configured to be removably connected to the vacuum body.

11. A vacuum cleaner, comprising:

a vacuum body for generating vacuum force;

a vacuum hose assembly; and a connector for connecting said vacuum hose assembly to said vacuum body, said connector comprising:

an elongate central tube;

an enclosure that partially encloses said central tube and said vacuum hose assembly, first and second portions of said central tube at opposite first and second ends of said central tube extending beyond respective ends of said enclosure and thus not being enclosed by said enclosure, said first portion of said central tube at said first end removably engaging with said vacuum body, said enclosure retaining said vacuum hose assembly in position partly alongside and outward of said second portion of said central tube beyond said second end of said enclosure to allow for swiveling of said vacuum hose assembly about said central tube; and a rotation prevention mechanism that prevents rotation of said enclosure relative to said central tube.

12. The vacuum cleaner of claim 11, wherein said rotation prevention mechanism comprises at least one rim on an inner surface of said enclosure that each include a keyway and a respective cooperating key on an outer surface of said central tube.

13. The vacuum cleaner of claim 11, wherein said rotation prevention mechanism comprises a plurality of rims on an inner surface of said enclosure that each include a keyway, and a plurality of cooperating keys on an outer surface of said central tube.

14. The vacuum cleaner of claim 11, wherein said enclosure comprises a pair of generally semi-cylindrical shells that are attached together.

15. The vacuum cleaner of claim 14, wherein said rotation prevention mechanism comprises at least one rim on an inner surface of each of said shells that each include a keyway, and a respective cooperating key on an outer surface of said central tube.

16. The vacuum cleaner of claim 11, wherein said first portion includes a first threaded portion and said vacuum body includes a second threaded portion that threadingly engages with said first threaded portion, said first threaded portion being configured to require a left-hand turn to engage with said second threaded portion and a right-hand turn to disengage with said second threaded portion.

17. The vacuum cleaner of claim 11, wherein said vacuum hose assembly comprises a flange and said enclosure comprises a pair of annular bearing surfaces on an inner surface that bear against an outer circumferential surface of said vacuum hose assembly when said vacuum hose assembly is positioned alongside and outward of said second portion of said central tube, one of said bearing surfaces being positioned above said flange of said vacuum hose assembly and the other of said bearing surfaces being positioned below said flange of said vacuum hose assembly.

18. The vacuum cleaner of claim 11, wherein said enclosure includes a rim on a same side of said central tube as said first portion, said first portion extending beyond said rim.

19. The vacuum cleaner of claim 11, wherein said connector in its entirety is configured to be removably connected to the vacuum body.

20. The vacuum cleaner of claim 11, wherein said enclosure is separate and apart from said vacuum body and said vacuum hose assembly is positioned adjacent to and between said second portion of said central tube and said enclosure such that said vacuum hose assembly is radially inward of said enclosure and radially outward of said central tube and thus in a radial direction, between said enclosure and said central tube.

21. A method for connecting a vacuum hose assembly to a vacuum cleaner body, comprising:

positioning an end of a vacuum hose of the vacuum hose assembly alongside and radially outward of a first portion of a central tube of a connector at a first end of the central tube, the connector including a second portion at a second end of the central tube opposite the first end and that removably engages with the vacuum body; then enclosing part of the central tube including part of the first portion alongside which the vacuum hose assembly is positioned, by means of an enclosure to thereby enclose part of the vacuum hose assembly and only part of the central tube, the first portion of the central tube alongside and outward of which the end of the vacuum hose is positioned and the second portion of the central tube at the first and second ends of the central tube respectively extending beyond respective ends of the enclosure and thus not being entirely enclosed by the enclosure, the step of enclosing part of the central tube comprising forming a channel in the enclosure to allow rotation of a flange of the vacuum hose assembly situated in the channel and forming cooperating rotation-prevention structure on the central tube and the enclosure such that when cooperating, the rotation-prevention structure prevents rotation of the enclosure relative to the central tube; and attaching the central tube to the vacuum body via the exposed part of the first portion, whereby swiveling of the vacuum hose relative to the central tube is permitted while rotation of the central tube relative to the enclosure is prevented.

22. The method of claim 21, wherein the step of forming cooperating rotation-prevention structure on the central tube and the enclosure comprises forming at least one keyway on a rim on an inner surface of the enclosure and at least one cooperating key on the central tube whereby presence of the key in a cooperating keyway prevents rotation of the enclosure relative to the central tube.

23. The method of claim 21, wherein the step of enclosing part of the central tube comprises positioning first and second shells each forming part of the enclosure against the central tube and part of the vacuum hose assembly positioned alongside and outward of the first portion of the central tube and then attaching the first and second shells together.

24. The method of claim 23, wherein the step of forming cooperating rotation-prevention structure on the central tube and the enclosure comprises forming at least one keyway on at least one rim on an inner surface of each of the shells and at least one cooperating key on the central tube whereby presence of the key in a cooperating keyway prevents rotation of the shells relative to the central tube.

25. The method of claim 21, wherein the second portion includes a first threaded portion and the connector is removably connected to the vacuum body by the first threaded portion adapted to threadingly engage with a second threaded portion on the vacuum body, further comprising configuring the first threaded portion to require a left-hand turn to engage with the second threaded portion.

* * * * *